US010750824B2

(12) United States Patent
Canfield et al.

(10) Patent No.: US 10,750,824 B2
(45) Date of Patent: Aug. 25, 2020

(54) FOOTBEDS HAVING VARYING COMPRESSION CHARACTERISTICS

(71) Applicant: San Antonio Shoe, Inc., San Antonio, TX (US)

(72) Inventors: Brock Canfield, San Antonio, TX (US); Kirk Bassett, San Antonio, TX (US)

(73) Assignee: San Antonio Shoe, Inc., San Antonio, TX (US)

( * ) Notice: Subject to any disclaimer, the term of this patent is extended or adjusted under 35 U.S.C. 154(b) by 71 days.

(21) Appl. No.: 15/955,458

(22) Filed: Apr. 17, 2018

(65) Prior Publication Data

US 2019/0313736 A1 Oct. 17, 2019

(51) Int. Cl.

| | |
|---|---|
| ***A43B 7/14*** | (2006.01) |
| ***A43B 17/08*** | (2006.01) |
| ***A43B 17/14*** | (2006.01) |
| ***A43B 13/38*** | (2006.01) |

(52) U.S. Cl.

CPC ..... *A43B 17/08* (2013.01); *A43B 7/141* (2013.01); *A43B 7/149* (2013.01); *A43B 7/1485* (2013.01); *A43B 13/38* (2013.01); *A43B 17/14* (2013.01)

(58) Field of Classification Search

CPC ..... A43B 7/1485; A43B 13/38; A43B 17/00; A43B 17/03; A43B 17/14

See application file for complete search history.

(56) References Cited

U.S. PATENT DOCUMENTS

| | | | | |
|---|---|---|---|---|
| 1,015,846 A | | 1/1912 | Shaw | |
| 2,307,416 A | * | 1/1943 | Margolin | A43B 7/223 36/147 |
| 2,308,529 A | * | 1/1943 | Margolin | A43B 17/08 36/3 B |
| 4,290,211 A | * | 9/1981 | Csengeri | A43B 7/082 36/3 B |
| 4,345,387 A | * | 8/1982 | Daswick | A43B 7/146 36/29 |
| 5,058,585 A | | 10/1991 | Kendall et al. | |
| 5,322,056 A | * | 6/1994 | Menghi | A43B 7/141 36/11.5 |
| 5,353,526 A | | 10/1994 | Foley et al. | |

(Continued)

OTHER PUBLICATIONS

AliExpress; "Medical Silicone gel U-Shape Plantar Fasciitis Heel Protector Spur Cushion Pad Pain Bone Spurs Achilles Shoes Inserts Insole" available as of Apr. 17, 2018 at: www.aliexpress.com/item/Silicone-heel-pad-heel-cushion/930951684.html?spm=2114.40010708.4.31.3ZTnlj; pp. 1-6.

(Continued)

*Primary Examiner* — Marie D Bays

(74) *Attorney, Agent, or Firm* — Bracewell LLP; Constance G. Rhebergen; Brian H. Tompkins

(57) ABSTRACT

Provided are footbeds having multiple points of contact and varying compression rates for use in articles of footwear. In one embodiment, a footbed may include apertures (for example, ovals) arranged in a varying grid density. In another embodiment, a footbed may include a lattice having edges that define polygons arranged in a constant grid density. In another embodiment, a footbed may include a lattice having edges that define polygons arranged in a constant grid density and having protruding structures within each polygon.

6 Claims, 8 Drawing Sheets

(56) References Cited

U.S. PATENT DOCUMENTS

| | | | | |
|---|---|---|---|---|
| 5,632,103 | A | 5/1997 | Suenaga | |
| 5,749,111 | A * | 5/1998 | Pearce | A43B 13/04 5/654 |
| 6,138,383 | A * | 10/2000 | Steinke | A43B 7/1425 36/141 |
| 6,425,194 | B1 * | 7/2002 | Brie | A43B 7/141 264/220 |
| 6,732,456 | B2 | 5/2004 | Hussain | |
| 7,041,075 | B2 | 5/2006 | Sullivan | |
| 7,475,497 | B2 * | 1/2009 | Hoffer | A43B 1/0009 36/28 |
| 8,296,969 | B2 | 10/2012 | Granger et al. | |
| 2001/0000369 | A1 | 4/2001 | Snyder et al. | |
| 2004/0016148 | A1 * | 1/2004 | Chen | A43B 17/02 36/44 |
| 2004/0168354 | A1 * | 9/2004 | Nguyen | A43B 7/147 36/43 |
| 2007/0271820 | A1 * | 11/2007 | Nurse | A41B 11/10 36/43 |
| 2013/0104419 | A1 * | 5/2013 | Horesh | A43B 7/1425 36/43 |
| 2014/0182049 | A1 * | 7/2014 | Prust | A47C 7/021 2/410 |
| 2016/0345666 | A1 * | 12/2016 | Kohatsu | A43B 7/144 |
| 2017/0245586 | A1 * | 8/2017 | Cook | A43B 13/12 |

OTHER PUBLICATIONS

No Foot Pain "U-Shaped Heel Cups Pads Heel Spurs Foot Pain" available as of Apr. 17, 2018 at: https://www.no-foot-pain.com/Ushaped_Heel_Cups_Pads_Heel_Spurs_Foot_Pain/p846018_3852056.aspx; pp. 1-2.

* cited by examiner

FOOTBEDS HAVING VARYING COMPRESSION CHARACTERISTICS

BACKGROUND

Field of the Disclosure

Embodiments of the disclosure generally relate to footwear and, in particular, a footbed that provides varying compression characteristics for use in articles of footwear.

Description of the Related Art

Articles of footwear (for example, shoes) may include a footbed to provide support and comfort for a wearer's foot. Footbeds may include a variety of different designs and materials, and the designs and materials may be selected based on the type of footwear (for example, athletic or orthotic footwear). However, existing footbeds may not provide sufficient support or comfort, especially under load-bearing areas of a foot. Additionally, the manufacture of footbeds having combinations of certain designs and materials may be difficult or currently unachievable. Moreover, certain footbed designs and materials may introduce durability problems.

SUMMARY

Embodiments of the disclosure include footbeds having multiple points of contact and varying compression rates for use in articles of footwear. As used herein, the term "footbed" may in some embodiments include or refer to an "insole" or "insert."

In one embodiment, a footbed for an article of footwear is provided. The footbed includes a body extending from the heel end of the footbed to the toe end of the footbed, such that the body has a thickness. The footbed further includes a plurality of apertures formed in the body and arranged in an irregular grid. The plurality of apertures include a first group of apertures having a first grid density and a first plurality of depths less than the thickness, and a second group of apertures having a second grid density and a second plurality of depths less than the thickness. The second group of apertures are located at a load-bearing area of the footbed, and the second grid density is different than the first grid density.

In some embodiments, each of the second plurality of depths of the second group of apertures is less than each of the first plurality of depths of the first group of apertures. In some embodiments, the plurality of apertures are a plurality of ovals. In some embodiments, the load-bearing area of the footbed corresponds to toes of a foot, a fifth metatarsal of a foot, a ball of a foot, or a heel of a foot. In some embodiments, the plurality of apertures define a plurality of contact points in the body of the footbed. In some embodiments, the first plurality of depths and the second plurality of depths are in the range of 1.5 millimeters (mm) to 2.5 mm. In some embodiments, the plurality of apertures are a number in the range of 200 to 450 apertures. In some embodiments, the body is polyurethane.

In another embodiment, another footbed for an article of footwear is provided. The footbed includes a body extending from the heel end of the foot bed to the toe end of the footbed, such that the body has a thickness, and an outer portion formed around the periphery of the body. The footbed also includes a lattice formed in the body, the lattice has edges that define a plurality of polygons. The plurality of polygons include a first group of polygons having a first plurality of depths less than the thickness and a second group of polygons having a second plurality of depths less than the thickness, such that the second group of polygons are located at a load-bearing area of the footbed and each of the second plurality of depths is less than each of the first plurality of depths.

In some embodiments, the second plurality of depths is equal to zero. In some embodiments, the plurality of polygons are a plurality of squares. In some embodiments, the load-bearing area of the footbed corresponds to toes of a foot, a fifth metatarsal of a foot, a ball of a foot, or a heel of a foot. In some embodiments, the outer portion defines a first point of contact relative to the ground and the edges of the lattice define a second point of contact relative to the ground. In some embodiments, the first plurality of depths and the second plurality of depths are in the range of 2.5 millimeters (mm) to 4 mm. In some embodiments, the plurality of polygons are a number in the range of 200 to 300 polygons. In some embodiments, the footbed includes a plurality of protruding structures each formed within a respective polygon of plurality of polygons, such that each of the plurality of protruding structures has a protruding depth less than the thickness but greater than the first depth and the second depth. In some embodiments, the plurality of protruding structures are a plurality of semispherical structures. In some embodiments, the outer portion defines a first point of contact relative to the ground, the plurality of protruding structures define a second point of contact relative to the ground, and the edges of the lattice define a third point of contact relative to the ground. In some embodiments, the body is polyurethane.

In another embodiment, another footbed for an article of footwear is provided. The footbed includes a body extending from a heel end of the footbed to a toe end of the footbed, such that the body has a thickness. The footbed further includes a plurality of apertures formed in the body and arranged in an irregular grid, such that the irregular grid has a varying grid density that is increased at a load-bearing area of the footbed and decreased at a non-load bearing area of the footbed. The plurality of apertures include varying depths such that the depth of the plurality of apertures is decreased at a load-bearing area of the footbed and increased at a non-load bearing area of the footbed. In some embodiments, the plurality of apertures have varying lengths or varying widths such that a length or width of the plurality of apertures is increased at a load-bearing area of the footbed and decreased at a non-load-bearing area of the footbed.

In another embodiments, another footbed for an article of footwear is provided. The footbed includes a body extending from a heel end of the footbed to a toe end of the footbed, such that the body has a thickness. The footbed further includes a lattice formed in the body and having edges that define a plurality of polygons. The plurality of polygons have varying depths such that the depth of the plurality of polygons is decreased at a load-bearing area of the footbed and increased at a non-load bearing area of the footbed

DETAILED DESCRIPTION

The present disclosure will now be described more fully hereinafter with reference to the accompanying drawings, which illustrate embodiments of the disclosure. This disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art.

Embodiments of the disclosure include footbeds having multiple points of contact and varying compression rates for use in articles of footwear. In some embodiments, a footbed may include apertures (for example, ovals) arranged in an irregular grid having varying grid density. The apertures may have different dimensions (for example, depth, length, and width) in load-bearing areas and non-load-bearing areas of the footbed. In some embodiments, a footbed may include a lattice (that is, a regular grid) having edges that define polygons arranged in a constant grid density. The polygons may have different depths in load-bearing areas and non-load-bearing areas of the footbed. In another embodiment, a footbed may include a lattice (that is, a regular grid) having edges that define polygons arranged in a constant grid density and having protruding structures within each polygon. The polygons may have different depths in load-bearing areas and non-load-bearing areas of the footbed, and the protruding structures may define an additional point of contact relative to the ground.

Footbed With Apertures Arranged in a Varying Grid Density

Figure 1:
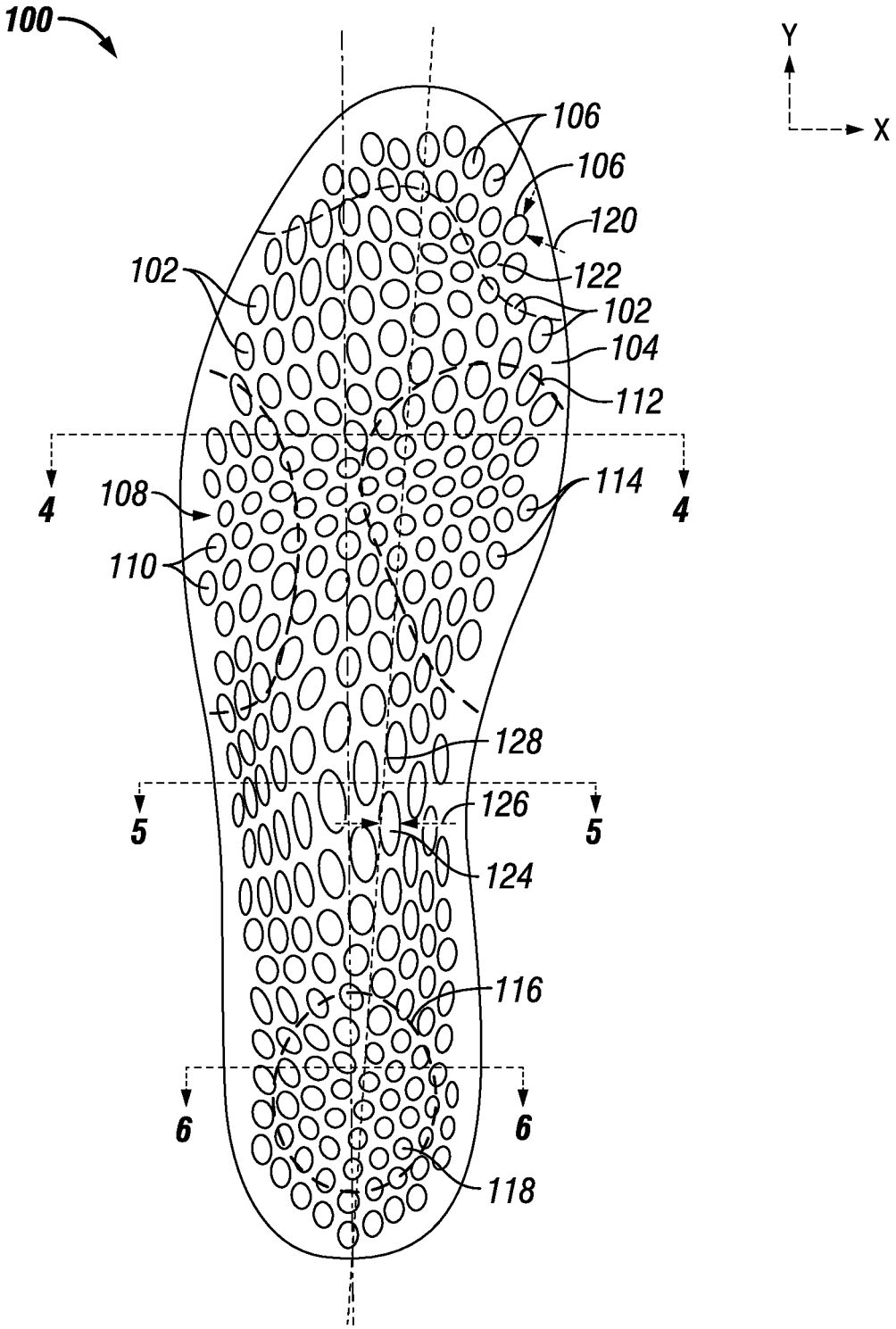
FIG. 1 is a bottom view of a footbed with apertures arranged in a varying grid density in accordance with an embodiment of the disclosure.

FIGS. 1-6 depict views of a footbed 100 with apertures arranged in a varying grid density in accordance with an embodiment of the disclosure. FIG. 1 is a bottom view of the footbed 100 and illustrates apertures 102 formed in a body of the footbed 100. For example, the body of the footbed may have a thickness and the apertures 102 may have depths less than the thickness, such that the apertures are defined by the absence of the material of the body. As shown in FIG. 1, the apertures are arranged in an irregular grid having a varying grid density, such that the apertures 102 are not arrange in regular rows or columns and have variable spacing in the x-direction and variable spacing in the y-direction. Moreover, the apertures 102 have different sizes in the x-direction, y-direction, and depth (z-direction). In certain embodiments, such as that shown in FIGS. 1-6, the apertures may be ovals and may be symmetrical in one direction or both directions. In other embodiments, the apertures may have different shapes.

The grid density of the apertures 102 may be increased at load-bearing or impact areas of the footbed and decreased at non-load-bearing or non-impact areas of the footbed 100. In certain embodiments, the load-bearing or impact areas may correspond to the toes of a foot, the ball of a foot, the fifth metatarsal of a foot, and the heel of a foot.

FIG. 1 illustrates the varying grid density of apertures with respect to the load-bearing areas of the footbed 100 and the contrast with the non-load-bearing areas of the foot bed 100. For example, area 104 having apertures 106 may correspond to the toes of the foot, area 108 having apertures 110 may correspond to the fifth metatarsal of a foot, area 112 having apertures 114 may correspond to the ball of the foot, and area 116 having apertures 118 may correspond to the heel of a foot. The areas of the footbed 100 other than areas 106, 108, 112, and 116 may be referred to as "non-load-bearing areas" of the footbed 100. However, it should be appreciated that under certain interactions of a foot with an environment the non-load-bearing areas may also experience a load from a foot.

FIG. 1 further illustrates the contrast in grid density between the load-bearing areas of the footbed 100 and the non-load bearing areas of the footbed 100. For example, areas 104, 108, 112, and 116 having apertures 106, 110, 114, and 118 respectively may each have an increased grid density as compared to non-load-bearing areas of the footbed 100. In some embodiments, the grid density of the areas 104, 108, 112, and 116 may be the different. In other embodiments, the grid density of the areas 106, 108, 112, and 116 may be the same.

Additionally, the sizes of the apertures in the increased grid density areas 106, 108, 112, and 116 may be different than the sizes of the apertures in the non-load-bearing areas. By way of example, an aperture 106 formed in the load-bearing area 104 may have a width 120 and a length 122. In contrast, an aperture 124 formed in a non-load-bearing area may have a width 126 different than (e.g., less than) the width 120 and a length 128 different than (e.g., greater than) the length 122 Similarly, the apertures 110 formed in load-bearing area 108, the apertures 114 formed in load-bearing area 112, and the apertures 116 formed in load-bearing area 118 may have widths and lengths different than the apertures in the non-load-bearing areas of the footbed.

Figure 2:
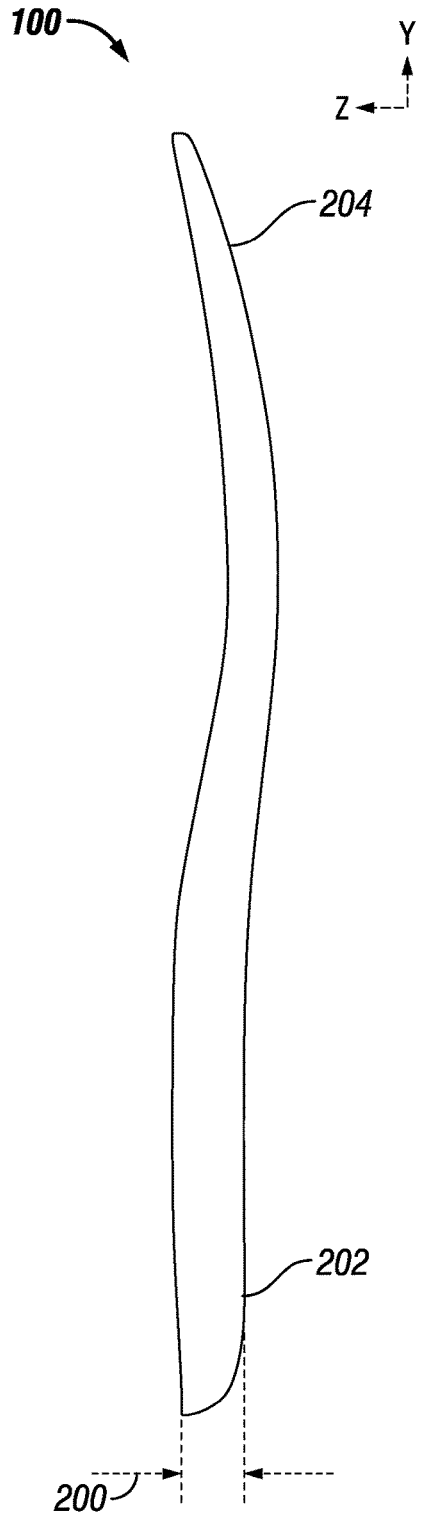
FIGS. 2 and 3 are side views of the footbed of FIG. 1 in accordance with an embodiment of the disclosure.
Figure 3:
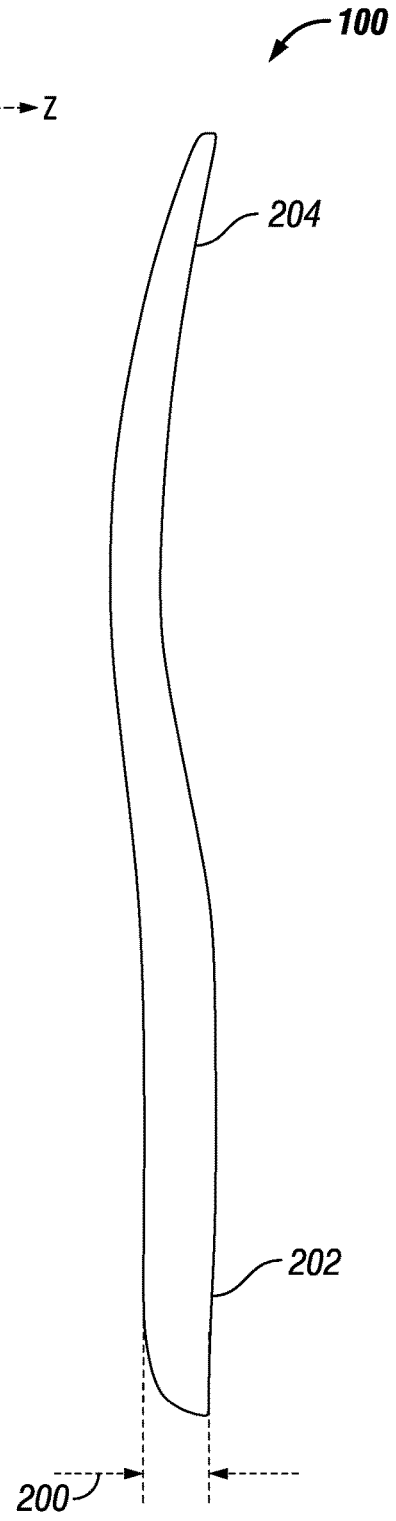

FIGS. 2 and 3 depict side views of the footbed 100 illustrating the thickness of the footbed 100 in accordance with an embodiment of the disclosure. As shown in these figures, the footbed 100 may have a variable thickness 200 that varies along the length of the footbed 102. For example, the thickness may greater at the heel end 202 of the footbed 100 and lesser at the toe end 204 of the foot bed 100. The apertures 102 formed in the footbed 100 may be formed be removing material of the footbed such that the depth of the apertures 102 is greater than zero but less than the thickness 200 of footbed.

Figure 4:
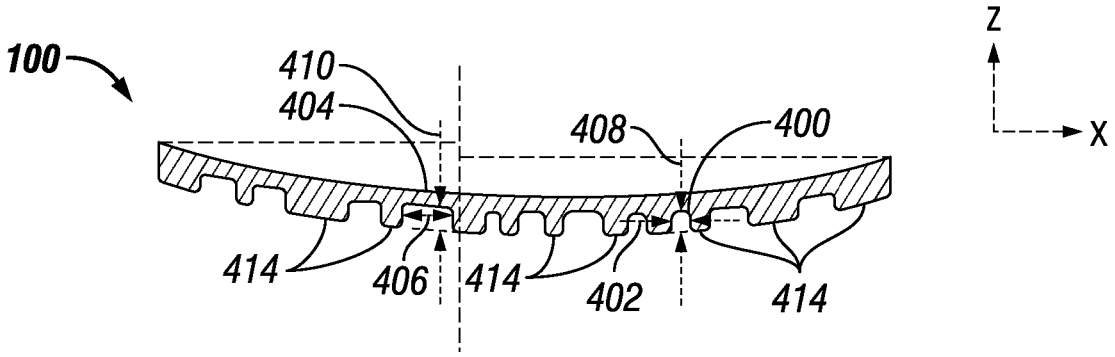
FIG. 4 is a cross-sectional view of the footbed of FIG. 1 taken along line 4-4 of FIG. 1 in accordance with an embodiment of the disclosure.

FIG. 4 is a cross-section of the footbed 100 taken along line 4-4 of FIG. 1 in accordance with an embodiment of the disclosure. The cross-section in FIG. 4 illustrates the varying dimensions of the apertures 102. For example, as shown in FIG. 4, the aperture 400 has a width 402 in the x-axis while the aperture 404 has a width 406 in the x-axis, with the width 406 greater than the width 402. FIG. 4 also illustrates the varying depths of the apertures 102. For example, the aperture 400 has a depth 408 in the z-axis that is less than the depth 410 of the aperture 404.

As shown in FIG. 4, the apertures 102 formed in the footbed 102 may define multiple contact points 414 when a load is applied to the footbed 100. For example, the contact points 414 may be the initial points of contact with the ground and may compress as a load is applied to the footbed 100. As will be appreciated, the dimensions (for example, depth, length, and width) of the apertures 102 may define the compression rate of the footbed 100.

Figure 5:
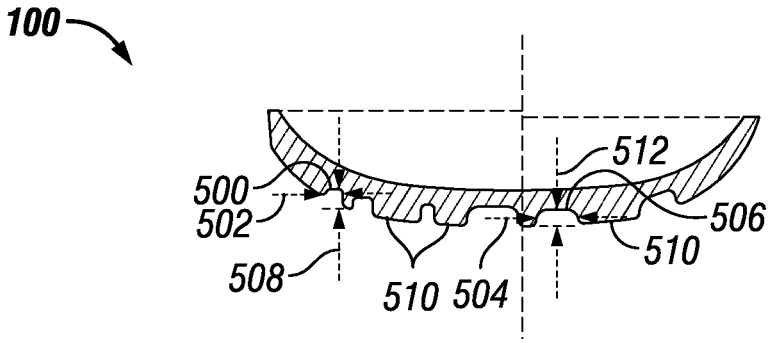
FIG. 5 is a cross-sectional view of the footbed of FIG. 1 taken along line 5-5 of FIG. 1 in accordance with an embodiment of the disclosure.

FIG. 5 is a cross-section of the footbed 100 taken along line 5-5 of FIG. 1 in accordance with an embodiment of the disclosure. The cross-section in FIG. 5 further illustrates the varying dimensions of the apertures 102 and depict a non-load-bearing area of the footbed 100. For example, as shown in FIG. 5, the aperture 500 has a width 502 in the x-axis while the aperture 506 has a width 504 in the x-axis, with the width 504 greater than the width 502. In another example, the aperture 500 has a depth 508 in the z-axis that is less than the depth 512 of the aperture 506.

As also illustrated by FIG. 5, the apertures formed in the footbed 102 may define multiple contact points 510 when a load is applied to the footbed 100. For example, the contact points 510 may be the initial points of contact with the ground and may compress as a load is applied to the footbed 100. As noted herein, the dimensions (for example, depth, length, and width) of the apertures 102 may define the compression rate of the footbed 100.

Figure 6:
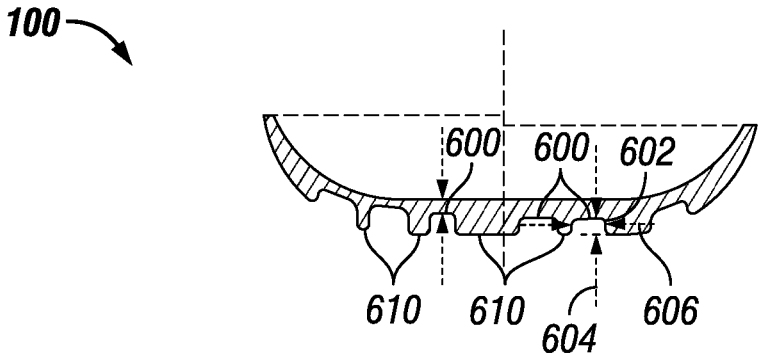
FIG. 6 is a cross-sectional view of the footbed of FIG. 1 taken along line 6-6 of FIG. 1 in accordance with an embodiment of the disclosure.

FIG. 6 is a cross-section of the footbed 100 taken along line 5-5 of FIG. 1 in accordance with an embodiment of the disclosure. The cross-section in FIG. 6 depicts apertures 600 located in the load-bearing area 116 of the footbed 100. In some embodiments, the apertures 600 in the load-bearing area 116 may have an increased grid density as compared to the apertures in the non-load-bearing areas of the foot bed (that is, the distance in the x-direction between the apertures 600 is less than the distance between the apertures in the non-load-bearing areas of the footbed). Similarly, the dimensions (for example, depth, length, and width) of the apertures 600 in the load-bearing area 112 may be different than the dimensions in non-load-bearing areas of the footbed 100.

As shown in FIG. 6, for example, the aperture 602 may have a depth 604 and a width 606. In some embodiments, the depth 604 may be different than the depths of apertures in non-load-bearing areas of the footbed 100. Similarly, in some embodiments the width 606 of the aperture 602 may be different than the widths of apertures in the non-load-bearing areas of the footbed 100. As is similar to the views shown in FIGS. 4 and 5, the cross-sectional view shown in FIG. 6 also depicts multiple contact points 610 defined by the apertures 600.

The footbed 100 described above and shown in FIGS. 1-6 may have a compression rate that varies across areas of the footbed 100. As discussed above, the grid density and dimensions (for example, depth, length, and width) of the apertures may be varied in different areas of the footbed 100 to provide different compression rates, such as in load-bearing areas of the footbed 100 versus non-load-bearing area of the footbed 100.

In some embodiments, the footbed 100 may have a number of apertures in the range of about 200 to about 450. In some embodiments, the depths of the apertures may in the range of 1.5 millimeters (mm) to about 2.5 mm. In some embodiments, the thickness along the length of the footbed 100 may vary from about 4 mm to about 18 mm.

The footbed 100 may further provide various manufacturing advantage and may provide a significant weight reduction that may enable the use of relatively heavier or denser materials. For example, in some embodiments the footbed 100 may be formed from polyurethane. In some embodiments, the footbed 100 may have a weight reduction of at least 25% as compared to a solid footbed formed from the same material. In certain embodiments, the footbed 100 may provide for improved manufacturing via molds (for example, gravity fed molds) and may minimize air voiding resulting from the molding process.

Footbed With Lattice and Polygons

Figure 7:
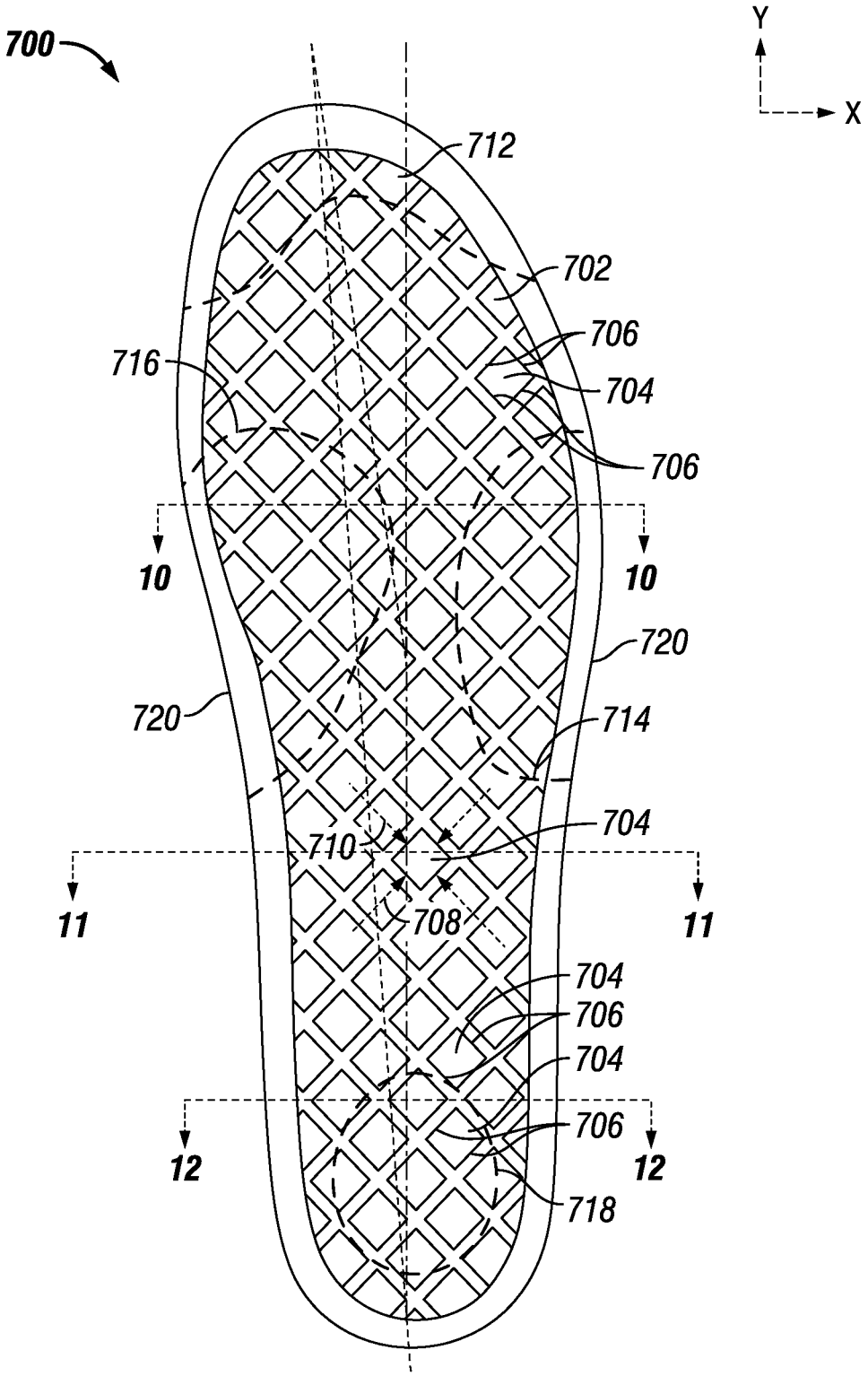
FIG. 7 is a bottom view of a footbed having a lattice that defines polygons in accordance with an embodiment of the disclosure.

FIGS. 7-14 depict views of a footbed 700 having a lattice 702 (that is, a regular grid) that defines 704 arranged in a constant grid density in accordance with an embodiment of the disclosure. FIG. 7 is a bottom view of the footbed 700 and illustrates polygons 704 formed in a body of the footbed 700 and defined by the edges 706 of the lattice 702. For example, the body of the footbed may have a thickness and the polygons 704 may have depths less than the thickness, such that the polygons 704 are defined by the absence of material of the body in the z-direction. As shown in FIG. 1, the polygons 704 are arranged in a regular grid having a constant grid density. Moreover, as discussed below, the polygons 704 may have varying depths such that the load-bearing areas of the footbed 700 have a thickness equal to the maximum thickness of the body of the footbed 700 (that is, the depth of the polygons is zero in these areas). As shown in FIG. 7, each of the polygons 704 may have a length 708 and width 710. In some embodiments, as shown in FIGS. 7-14, the polygons 704 may be squares such that the length 708 and width 710 are equal. In other embodiments, other types of polygons may be formed in the footbed 700.

FIG. 7 illustrates the load-bearing areas of the footbed 700: for example, area 712 may correspond to the toes of a foot, area 714 may correspond to the fifth metatarsal of a foot, area 716 may correspond to the ball of a foot, and area 718 may correspond to the heel of a foot. The footbed 700 may be surrounded by an outer portion 720 having a thickness of the footbed 700. As discussed below, the thickness of the outer portion 720 may vary along the length of the footbed 700. In some embodiments, the thickness of the outer portion 720 may be equal to the maximum thickness of the body of the footbed 700.

Figure 8:
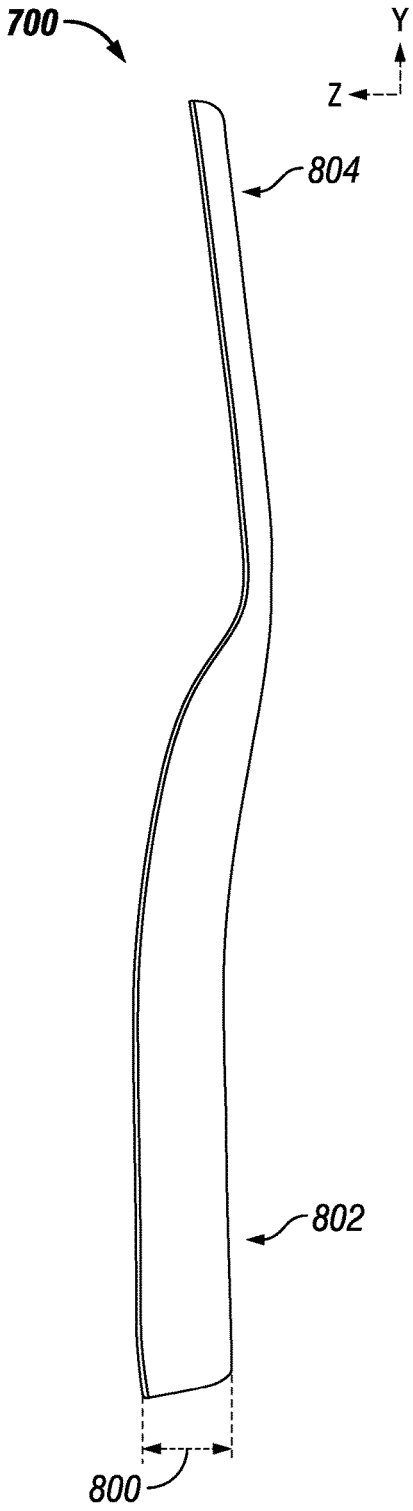
FIGS. 8 and 9 are side views of the footbed of FIG. 7 in accordance with an embodiment of the disclosure.
Figure 9:
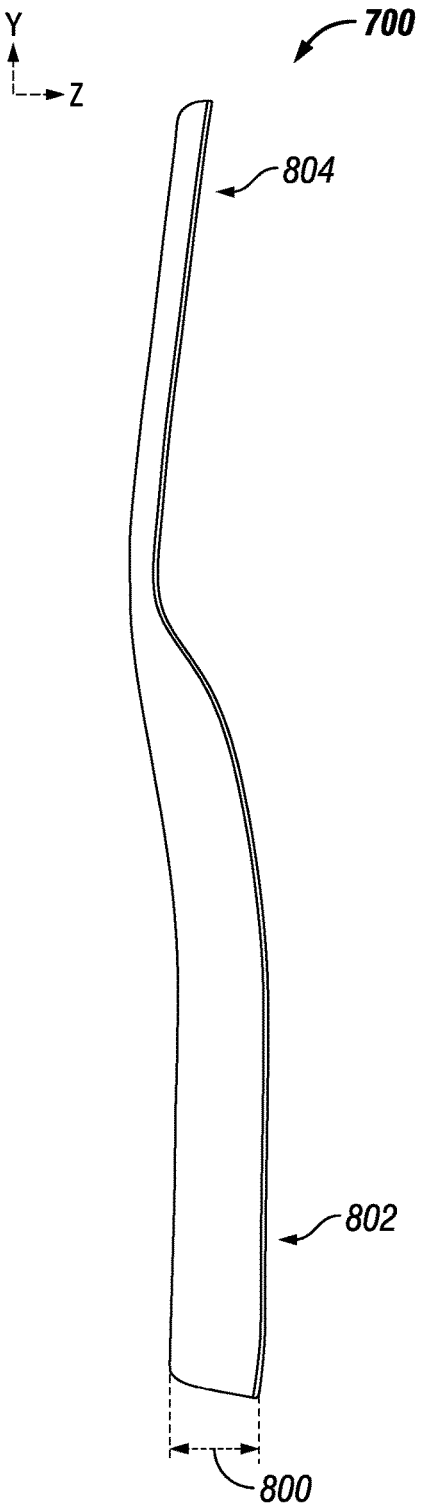

FIGS. 8 and 9 depict side views of the footbed 700 illustrating the thickness of the outer portion 720 in accordance with an embodiment of the disclosure. As shown in these figures, the outer portion 720 may have a variable thickness 800 that varies along the length of the footbed 700. For example, the thickness may be greater at the heel end 802 of the footbed 700 and reduced at the toe end 804 of the foot bed 700. In some embodiments, the thickness 800 may be equal to the maximum thickness of the body of the footbed 700. The polygons 704 may be defined by the absence of material of body of the footbed 700 such that the depth of the polygons is greater than zero but less than the thickness 800 of the outer portion 720

Figure 10:
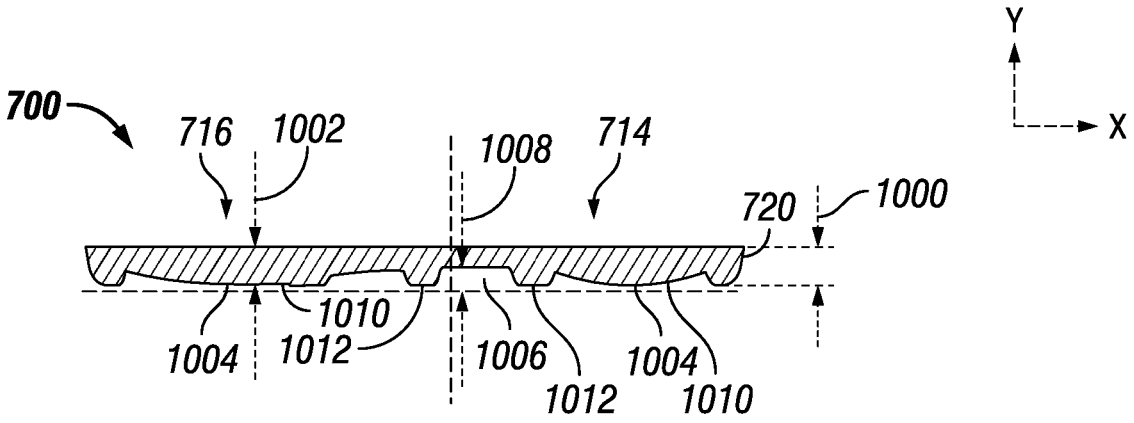
FIG. 10 is a cross-sectional view of the footbed of FIG. 7 taken along line 10-10 of FIG. 1 in accordance with an embodiment of the disclosure.

FIG. 10 is a cross-section of the footbed 700 taken along line 10-10 of FIG. 7 in accordance with an embodiment of the disclosure. FIG. 10 depicts the outer portion 720 having a thickness 1000 at the area of the footbed shown in FIG. 10. The cross-section in FIG. 10 illustrates the varying depth of the polygons 1004 in the lattice 702 in different areas of the footbed 700. For example, as shown in FIG. 10, the polygons 704 have a depth of zero in the load-bearing areas 714 and 716. That is, in the load-bearing areas 714 and 716, the lattice 702 has a thickness 1002 equal to the thickness of the body of the footbed 700. In contrast, the polygons 1006 in a non-load-bearing area of the footbed 700 have a depth 1008 that is less than the maximum thickness of the body of the footbed 700.

FIG. 10 also illustrates contact points 1010 and 1012 of the footbed 700. A shown in the figure, the contact points 1010 in the load-bearing area 714 and 716 may have a greater surface area than the contact points 1012 in the non-load-bearing areas of the footbed 700 (for example, the contact points 1012 in the non-load-bearing area of the footbed 700 may correspond to the edges 706 of the lattice 702).

Figure 11:
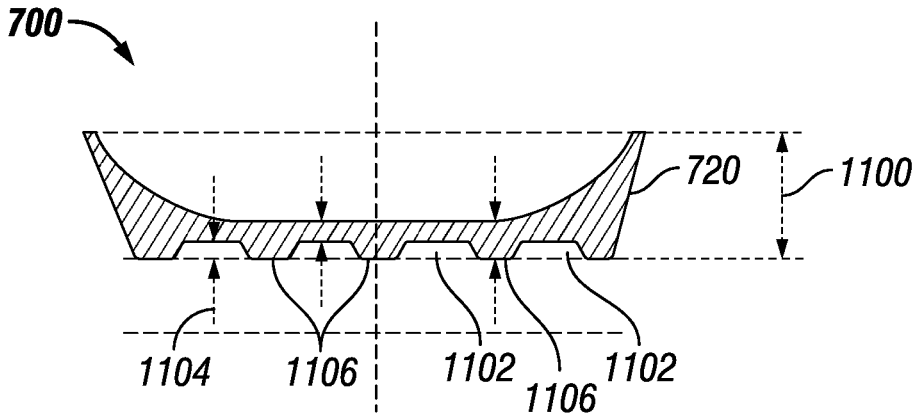
FIG. 11 is a cross-sectional view of the footbed of FIG. 7 taken along line 11-11 of FIG. 1 in accordance with an embodiment of the disclosure.

FIG. 11 is a cross-section of the footbed 700 taken along line 11-11 of FIG. 7 in accordance with an embodiment of the disclosure. FIG. 11 depicts the outer portion 720 having a thickness 1100 at the area of the footbed shown in FIG. 11. The cross-section in FIG. 11 illustrates the depth of the polygons 704 defined by the lattice 702 in a non-load-bearing area of the footbed 700. For example, as shown in FIG. 11, the polygons 1102 have a non-zero depth 1104 in the non-load-bearing area shown in FIG. 11. FIG. 11 also illustrates contact points 1106 of the footbed 700 that correspond to the edges 706 of the lattice 702.

Figure 12:
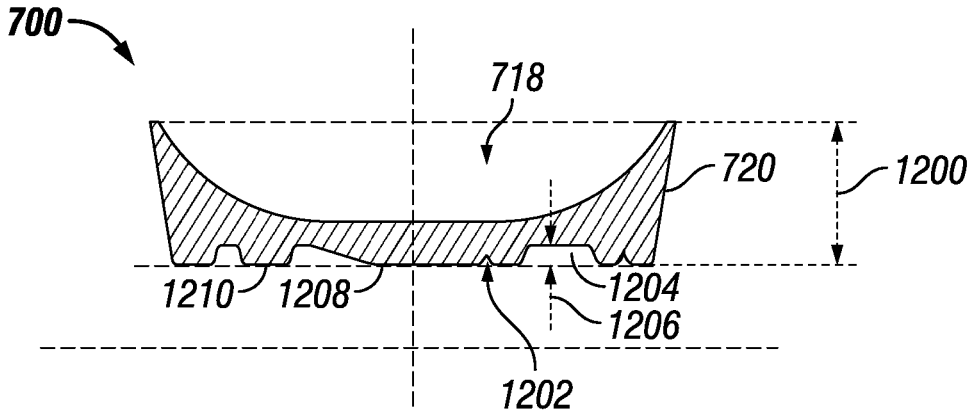
FIG. 12 is a cross-sectional view of the footbed of FIG. 7 taken along line 12-12 of FIG. 1 in accordance with an embodiment of the disclosure.

FIG. 12 is a cross-section of the footbed 700 taken along line 12-12 of FIG. 7 in accordance with an embodiment of the disclosure. FIG. 12 also depicts the outer portion 720 having a thickness 1200 at the area of the footbed shown in FIG. 12. Here again, the cross-section in FIG. 12 illustrates the varying depth of the polygons 704 in the lattice 702 in different areas of the footbed 700. For example, as shown in FIG. 12, the polygons 704 have a depth of zero in the load-bearing area 718. That is, in the load-bearing area 718, the lattice 702 has a thickness 1202 equal to the thickness of the body of the footbed 700 at that area. In contrast, the polygons 1204 in a non-load-bearing area of the footbed 700 have a depth 1206 that is less than the thickness of the body of the footbed 700 at that area.

FIG. 12 also illustrates contact points 1208 and 1210 of the footbed 700. A shown in the figure, the contact points 1208 in the load-bearing area 718 may have a greater surface area than the contact points 1210 in the non-load-bearing areas of the footbed 700 (for example, the contact points 1210 in the non-load-bearing area of the footbed 700 may correspond to the edges 706 of the lattice 702).

The footbed 700 described above and shown in FIGS. 7-12 may have a compression rate that varies across areas of the footbed 700. As discussed above, the thickness of the lattice (that is, the depth of the polygons) may be varied in different areas of the footbed 700 to provide different compression rates, such as higher compression rates in load-bearing areas of the footbed 700 and lower compression rates in non-load-bearing area of the footbed 700.

In some embodiments, the footbed 700 may have a number of polygons 704 in the range of about 200 to about 300. In some embodiments, the spacing between polygons (that is, the distance between the center of a polygon from the center of an adjacent polygon) may be in the range of about 10 mm to about 12 mm. In some embodiments, the depths of the polygons 704 of the footbed 700 may be in the range of 2.5 millimeters (mm) to about 4 mm. In some embodiments, the thickness of the outer portion along the length of the footbed 700 may be in the range of about 6.5 mm to about 20 mm.

The footbed 700 may further provide various manufacturing advantage and may provide a significant weight reduction that may enable the use of relatively heavier or denser materials. For example, in some embodiments the footbed 700 may be formed from polyurethane. In certain embodiments, the footbed 700 may provide for improved manufacturing via molds (for example, gravity fed molds) and may minimize air voiding resulting from the molding process. In such embodiments, the spacing between polygons of the footbed 700 may be selected to minimize or eliminate air voiding during a molding process to produce the footbed 700.

Footbed With Lattice and Protruding Structures

Figure 13:
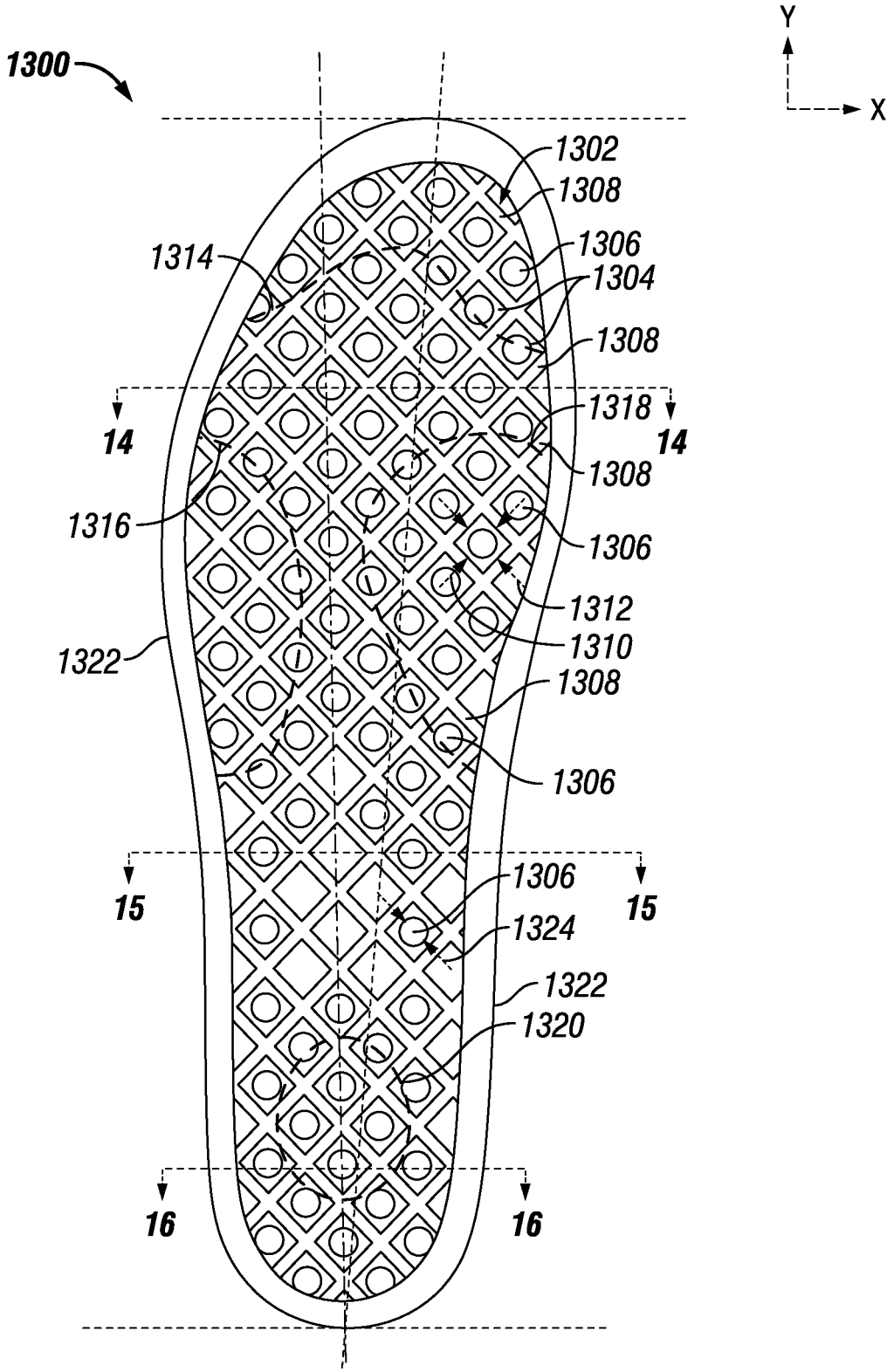
FIG. 13 is a bottom view of a footbed with a lattice structure and protruding structures in accordance with an embodiment of the disclosure.

FIGS. 13-16 depict views of a footbed 1300 having a regular grid (for example, a lattice 1302) that defines polygons 1304 with a constant grid density and protruding structures 1306 in accordance with an embodiment of the disclosure. FIG. 13 is a bottom view of the footbed 1300 and illustrates polygons 1304 formed in a body of the footbed 1300 and defined by edges 1308 of the lattice 1302. For example, the body of the footbed may have a thickness and the polygons 1304 may have depths less than the thickness, such that the polygons 1304 are defined by the absence of material of the body in the z-direction. As shown in FIG. 1, the polygons 1304 are arranged in a regular grid (for example, a lattice 1302) having a constant grid density. As will be appreciated, the lattice 1302, polygons 1304, and edges 1308 may be similar to and the have the same characteristics as the lattice 702, polygons 704, and edges 706 of the footbed 700 described above and illustrated in FIGS. 7-12. For example, the polygons 1304 may have varying depths such that the load-bearing areas of the footbed 1300 have a thickness equal to the maximum thickness of the body of the footbed 1300 (that is, the depth of the polygons is zero in these areas). As shown in FIG. 13, each of the polygons 1304 may have a length 1310 and width 1312. In some embodiments, as shown in FIG. 13, the polygons 1304 may be squares such that the length 1310 and width 1312 are equal. In other embodiments, other types of polygons may be formed in the footbed 1300.

FIG. 13 illustrates the load-bearing areas of the footbed 1300: for example, area 1314 may correspond to the toes of a foot, area 1316 may correspond to the fifth metatarsal of a foot, area 1318 may correspond to the ball of a foot, and area 1320 may correspond to the ball of a foot. The footbed 700 may be surrounded by an outer portion 1322 defining a thickness of the footbed 1300, which may be similar to outer portion 720 described above. The thickness may vary along the length of the footbed 1300.

Each protruding structure 1306 may be formed in the center of the polygon 1304 defined by the lattice 1302. In some embodiments, each protruding structure 1306 may be semispherical in shape and may have varying thicknesses such that the protruding structures 1306 located in the load-bearing areas of the footbed 1300 may have a thickness equal to the thickness of the footbed 1300. As shown in FIG.

13, each of the protruding structures 1306 may have a diameter 1324 that, in some embodiments, may be the same for each protruding structure 1306. In other embodiments, the protruding structure 1306 may be pyramidal shaped, square-shaped, or any other suitable shape.

Figure 14:
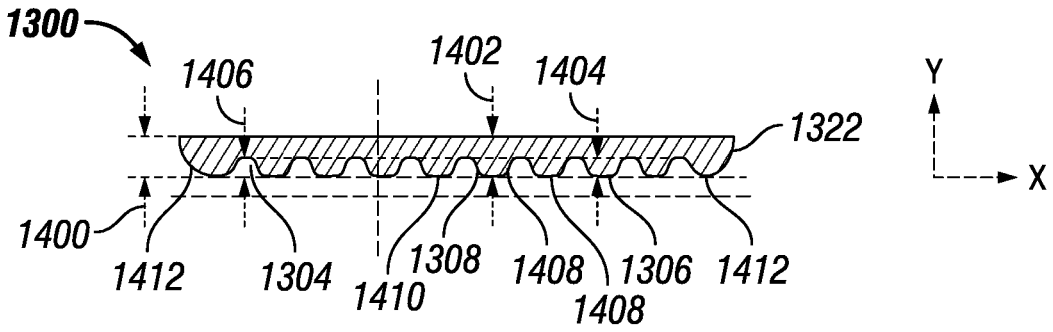
FIG. 14 is a cross-sectional view of the footbed of FIG. 13 taken along line 14-14 of FIG. 1 in accordance with an embodiment of the disclosure.

FIG. 14 is a cross-section of the footbed 1300 taken along line 14-14 of FIG. 13 in accordance with an embodiment of the disclosure. FIG. 14 depicts the outer portion 1322 of the footbed 700 having a thickness 1400. The cross-section in FIG. 14 further illustrates the varying depths of the polygons 1304 and thicknesses of the protruding structures 1306. As shown in FIG. 14, the edges 1308 of the lattice 1302 may have a thickness 1402, and the protruding structures 1306 may have a thickness 1404. As also shown in FIG. 14, the polygons 1304 may have a depth of 1406.

As will be appreciated by the view illustrated in FIG. 14, the outer portion 1322, the lattice 1302, and protruding structures 1306 may provide different points of contact and rates of compression for the footbed 1300. For example, the edges 1308 of the lattice 1302, the protruding structures 1306, and the outer portion 1322 may define contacts points 1408, 1410, and 1412 respectively. For example, the contact points 1412 defined by the outer portion 1322 may be the initial points of contact with the ground. After compression of the outer portion 1322, the contact points 1410 defined by the protruding structures 1306 may be the second point of contact. After compression of the protruding structures 1306, the edges 1308 of the lattice 1302 may provide additional contact points 1402 with the ground.

Figure 15:
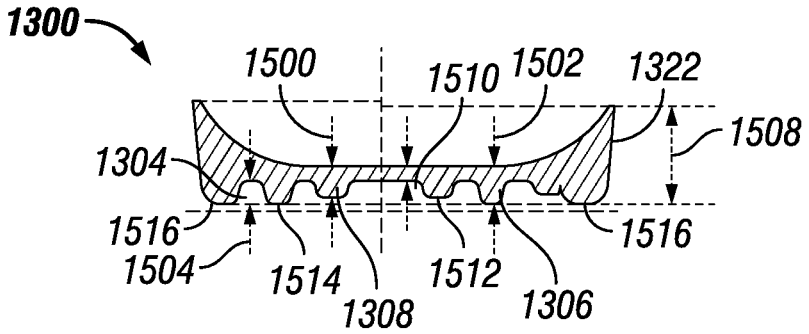
FIG. 15 is a cross-sectional view of the footbed of FIG. 13 taken along line 15-15 of FIG. 1 in accordance with an embodiment of the disclosure.

FIG. 15 is a cross-section of the footbed 1300 taken along line 15-15 of FIG. 13 in accordance with an embodiment of the disclosure. The cross-section in FIG. 15 further illustrates the depths of the polygons 1304 and thicknesses of protruding structures 1306. As shown in FIG. 15, the edges 1308 of the lattice 1302 may have a thickness 1500, and the protruding structures 1306 shown in FIG. 15 may have a thickness 1502. The polygons 1304 shown in FIG. 15 may have a depth 1506. FIG. 15 also depicts the outer portion 1322 of the footbed 1300 having a thickness 1508. In some embodiments, for example, the thickness 1500 of the outer portion 1322 is greater in the area of the footbed 1300 shown in FIG. 15 as compared to the area of the footbed 1300 shown in FIG. 14.

In some embodiments, a polygon defined by the lattice 1302 may not include a protruding structure 1306. For example, as shown in FIG. 15, the polygon 1510 does not include a protruding structure within the polygon 1510. For example, in some embodiments, polygons located in non-load-bearing areas of the footbed 1300 may not include protruding structures and the corresponding contact points and compression rate provided by the protruding structures.

Here again, as shown in FIG. 15, the outer portion 1322, the lattice 1302, and the protruding structures 1306 may provide different points of contact and rates of compression for the footbed 1300. As shown in FIG. 15, the edges 1308 of the lattice 1302, the protruding structures 1306, and the outer portion 1322 may define contacts points 1512, 1514, and 1516 respectively. For example, the contact points 1516 of the outer portion 1322 may be the initial points of contact with the ground, and the contact points 1514 defined by the protruding structures 1306 may be the second point of contact. After compression of the protruding structures 1306, the edges 1308 of the lattice 1302 may provide additional contact points 1512.

Figure 16:
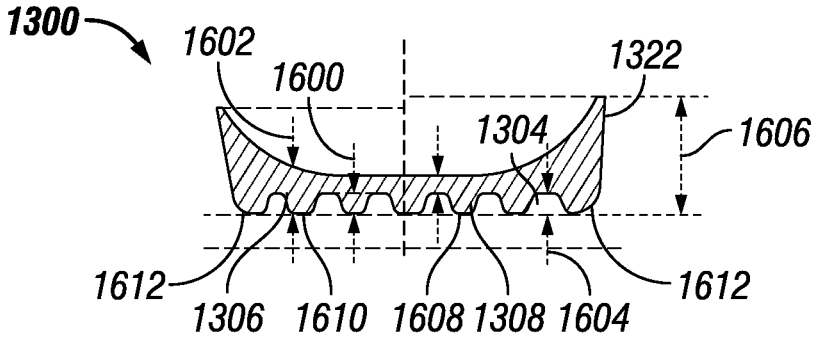
FIG. 16 is a cross-sectional view of the footbed of FIG. 13 taken along line 16-16 of FIG. 1 in accordance with an embodiment of the disclosure.

FIG. 16 is a cross-section of the footbed 1300 taken along line 16-16 of FIG. 13 in accordance with an embodiment of the disclosure. The cross-section in FIG. 16 again illustrates the varying depths of the polygons 1304 and thicknesses of the protruding structures 1306. As shown in FIG. 16, the edges 1308 shown in FIG. 16 may have a thickness 1600, and the protruding structures 1306 may have a thickness 1602. The polygons 1304 may have a depth 1604. FIG. 16 also depicts the outer portion 1322 of the footbed 1300 having a thickness 1606.

As discussed above, the outer portion 1322, the lattice 1302, and the protruding structures 1306 may provide different points of contact and rates of compression for the footbed 1300. As shown in FIG. 16, the edges 1308 of the lattice 1302, the protruding structures 1306, and the outer portion 1322 may define contacts points 1608, 1610, and 1612 respectively. Here again, the contact points 1612 defined by the outer portion 1322 may be the initial points of contact with the ground, and the contact points 1610 defined by the protruding structures 1306 may be the second point of contact. After compression of the protruding structures 1306, the edges 1308 of the lattice 1302 may provide additional contact points 1608.

The footbed 1300 described above and shown in FIGS. 13-16 may have a compression rate that varies across areas of the footbed 700. As discussed above, the thickness of the lattice (that is, the depth of the polygons) and the presence of protruding structures may be varied in different areas of the footbed 1300 to provide different compression rates, such as higher compression rates in load-bearing areas of the footbed 1300 and lower compression rates in non-load-bearing area of the footbed 1300. For example, a load-bearing area of the footbed 1300 may include a lattice having an increased thickness and protruding structures, while a non-load-bearing area of the footbed 1300 may include a lattice having a reduced thickness and without protruding structures.

In some embodiments, the footbed 1300 may have a number of polygons 1304 in the range of about 200 to about 300. In some embodiments, the spacing between polygons 1304 (that is, the distance between the center of a polygon from the center of an adjacent polygon) may be in the range of about 10 mm to about 12 mm. In some embodiments, the depths of the polygons 1304 of the footbed 1300 may be in the range of 2.5 millimeters (mm) to about 4 mm. In some embodiments, the thickness of the outer portion along the length of the footbed 1300 may be in the range of about 6.5 mm to about 20 mm.

The footbed 1300 may further provide various manufacturing advantages and may provide a significant weight reduction that may enable the use of relatively heavier or denser materials. For example, in some embodiments the footbed 1300 may be formed from polyurethane. In certain embodiments, the footbed 1300 may provide for improved manufacturing via molds (for example, gravity fed molds) and may minimize air voiding resulting from the molding process. In such embodiments, the spacing between polygons of the footbed 1300 and the size and shape of the protruding structures may be selected to minimize or eliminate air voiding during a molding process to produce the footbed 1300.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described herein. It is to be understood that the forms shown and described herein are to be taken as examples of embodiments. Elements and materials may be substituted for those illustrated and described herein, parts and processes may be reversed or omitted, and certain features may be utilized independently, all as would be apparent to one skilled in the art after having the benefit of this description. Changes may be made in the elements described herein without departing from the spirit and scope of the disclosure as described in the following claims. Headings used herein are for organizational purposes only and are not meant to be used to limit the scope of the description.

What is claimed is:

1. A footbed for an article of footwear, comprising:

a body extending from the heel end of the footbed to the toe end of the footbed, the body comprising a thickness;

a plurality of apertures formed in the body and arranged in a grid, the plurality of apertures comprising:

a first group of apertures comprising a first grid density and a first plurality of depths less than the thickness, and a second group of apertures comprising a second grid density and a second plurality of depths less than the thickness, the second group of apertures located at load-bearing areas of the footbed, wherein the second density is greater than the first density and the second group of apertures are smaller than the first group of apertures, wherein the load-bearing areas of the footbed correspond to toes of a foot, a ball of a foot, and a heel of a foot, wherein the plurality of apertures comprise a plurality of ovals.

2. The footbed of claim 1, wherein each of the second plurality of depths of the second group of apertures is less than each of the first plurality of depths of the first group of apertures.

3. The footbed of claim 1, wherein the plurality of apertures define a plurality of contact points in the body of the footbed, the contact points comprising initial points of contact between the article of footwear and the ground when a load is applied to the footbed.

4. The footbed of claim 1, wherein the first plurality of depths and the second plurality of depths comprise depths in the range of 1.5 millimeters (mm) to 2.5 mm.

5. The footbed of claim 1, wherein the plurality of apertures comprise a number in the range of 200 to 450 apertures.

6. The footbed of claim 1, wherein the body comprises polyurethane.

* * * * *